US006526590B2

(12) United States Patent
Tierney

(10) Patent No.: US 6,526,590 B2
(45) Date of Patent: Mar. 4, 2003

(54) NECKWEAR WITH SAFETY FEATURE

(76) Inventor: Daniel E. Tierney, 160 Hawkins Rd., Centereach, NY (US) 11720

( * ) Notice: Subject to any disclaimer, the term of this patent is extended or adjusted under 35 U.S.C. 154(b) by 0 days.

(21) Appl. No.: 09/814,577

(22) Filed: Mar. 22, 2001

(65) Prior Publication Data

US 2001/0042260 A1 Nov. 22, 2001

Related U.S. Application Data

(60) Provisional application No. 60/191,256, filed on Mar. 22, 2000.

(51) Int. Cl.[7] ..... A41D 25/16
(52) U.S. Cl. ..... 2/144; 2/155
(58) Field of Search ..... 2/144, 155, 145, 2/146, 207, 48, 50, 51, 52, 46, 916, 920, 912; 24/49.1, 50, 56, 59

(56) References Cited

U.S. PATENT DOCUMENTS 2,066,126 A * 12/1936 Samter et al. ..... 2/155
3,335,427 A * 8/1967 Eads ..... 2/155
3,439,360 A * 4/1969 Grubman ..... 2/155
3,494,522 A * 2/1970 Kim et al. ..... 225/97
3,733,614 A * 5/1973 Abramowitz ..... 2/144
3,737,917 A * 6/1973 Orr ..... 2/150
3,872,513 A * 3/1975 Beaudin, Jr. et al. ..... 2/155
4,539,238 A * 9/1985 Markowitz ..... 428/43
4,627,113 A * 12/1986 Lord ..... 2/144
4,777,665 A * 10/1988 Akamatsu ..... 2/155
4,856,115 A * 8/1989 Knapp ..... 2/155
4,892,769 A * 1/1990 Perdelwitz, Jr. et al. ..... 428/68
5,353,486 A * 10/1994 Schmidt et al. ..... 28/167
5,440,787 A * 8/1995 Figueroa et al. ..... 24/50
5,507,079 A * 4/1996 Schmidt et al. ..... 28/170
5,600,851 A * 2/1997 McLeod ..... 2/144
5,600,852 A * 2/1997 Densch ..... 2/144

* cited by examiner

*Primary Examiner*—John J. Calvert
*Assistant Examiner*—Alissa L. Hoey
(74) *Attorney, Agent, or Firm*—Daniel E. Tierney

(57) ABSTRACT

An article of neckwear, the article comprising at least one separable region. The separable region separates the neckwear into at least two portions when a force that exceeds a threshold is applied across the separable region. Also, a method of making an article of neckwear comprising the step of treating at least one region such that it has a reduced fabric strength than other regions of the neckwear.

8 Claims, 2 Drawing Sheets

NECKWEAR WITH SAFETY FEATURE

CLAIM OF PRIORITY

This Application claims priority under 35 U.S.C. §119(e) to U.S. Provisional Application Ser. No. 60/191,256 filed with the U.S. Patent and Trademark Office on Mar. 22, 2000.

FIELD OF THE INVENTION

The invention relates to articles of clothing that are worn around the neck, such as men's neckties, scarves, etc.

BACKGROUND OF THE INVENTION

Many standard articles of clothing are worn around the neck, referred to herein as "neckwear". The most prominent examples are scarves and men's neckties. Neckties are required attire for men in many settings, such as at work and many different social and professional gatherings. Scarves, neckties and other neckwear are considered fashion items and are substantial revenue generators for many designers, distributors and retail outlets.

Neckwear, however, is potentially dangerous to the wearer. The typical silk necktie, for example, surrounds the neck, is knotted close to the Adam's Apple, and generally hangs down to below the navel. It is fashionable to wear a necktie hanging freely from the neck, a length of approximately 16–20 inches (depending on the height of the wearer, the length of the tie and how it is tied). This creates the potential danger that the freely hanging portion of the tie will catch on a moving object, such as a passing vehicle. The danger is compounded by the wind that can be generated by such a vehicle (and/or the natural environment), which may suddenly whip the end of the tie away from the wearer. The typical silk necktie is relatively strong and will only tear when a substantial amount of force is applied. Thus, if the tie catches on a moving object, there is a danger that the wearer will suffer a serious or fatal neck injury.

Although tie clips and other like devices exist that tether a portion of the free end of the necktie to the wearer, as noted, many wearers choose not to use such devices. In addition, such devices still leave the lower portion of the tie free and thus reduce, but do not eliminate the danger. Also, other neckwear, such as scarves, are generally worn without such a tethering device.

SUMMARY OF THE INVENTION

It is thus an objective of the invention to provide safe neckwear. In particular, it is an objective of the invention to provide neckwear that will tear away from the wearer when a significant but non-injurious amount of force is applied to the neckwear. It is also an objective of the invention to provide a device and method for creating safe neckwear.

In accordance with these objectives, the invention provides neckwear that includes at least one weakened region therein, the weakened region allowing the neckwear to tear if a force is applied, the tearing of the weakened region occurring for an applied force less than the force otherwise required to tear the fabric of the neckwear. Thus, for example, the invention includes neckties having perforations extending across the width of the tie at a location approximately one-third down the length of the tie. When the necktie is tied, the perforations lie approximately at the back of the wearer's neck. A force applied to the hanging portion of the tie will cause the tie to tear apart at the perforations and allow the tie to be pulled free of the wearer, before the wearer's neck is injured.

The invention also provides a method of providing safe neckwear, the method including the step of creating at least one weakened region in the neckwear, the weakened region positioned to allow the neckwear to tear if a force is applied, the tearing of the weakened region occurring for an applied force less than the force otherwise required to tear the fabric of the neckwear.

The invention also provides an apparatus for creating safe neckwear. The apparatus includes a mold or positioner that aligns a particular segment along the length of the neckwear with respect to a cutting element of the apparatus. The segment is located at a point along the length of the neckwear that normally lies behind the user's neck when being worn. The cutting element provides a weakened region across the width of the neckwear.

DETAILED DESCRIPTION

Figure 1:
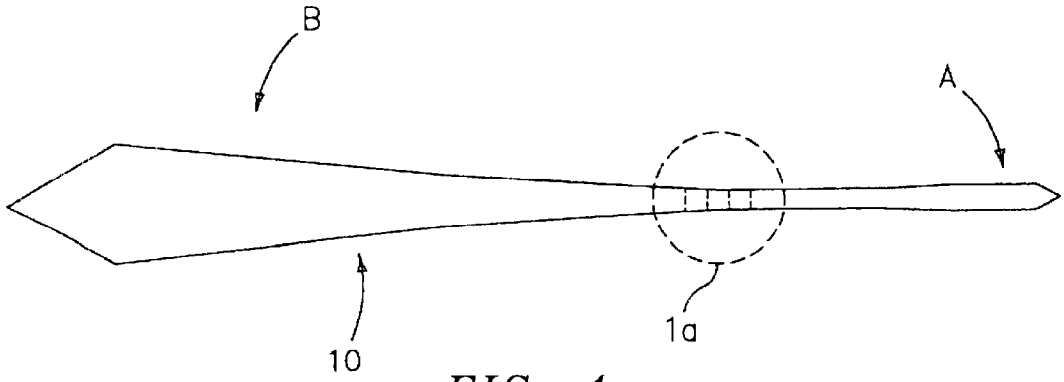
FIG. 1 is a necktie in accordance with an embodiment of the invention.
Figure 1A:
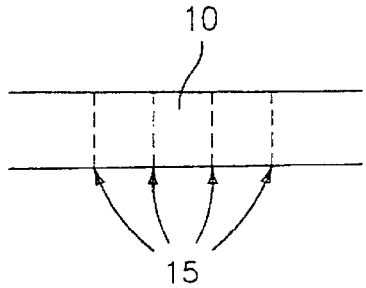
FIG. 1*a* is a close-up view of the portion of the necktie shown in the dashed circle of FIG. 1.

Referring to FIG. 1, a standard silk necktie 10 with a diagonal stripe pattern. The necktie includes a number of weakened regions 15 extending across the width of the tie, as best seen in FIG. 1*a*. The weakened regions may be, for example, a series of perforations. The regions 15 are located in a region approximately one-third down the length of the tie, starting on the narrow end of the necktie (designated "A" in FIG. 1). One or more weakened regions 15 in relatively close proximity, such as those shown in FIG. 1, is referred to as a "separable region".

Figure 2A:
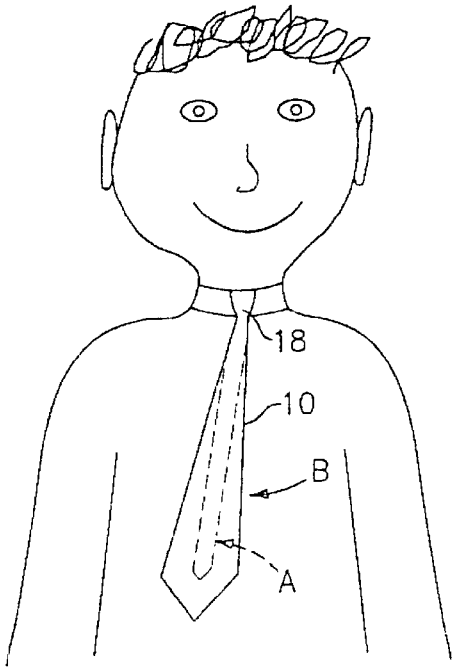
FIG. 2*a* shows a person wearing the necktie of FIG. 1 from the front.
Figure 2B:
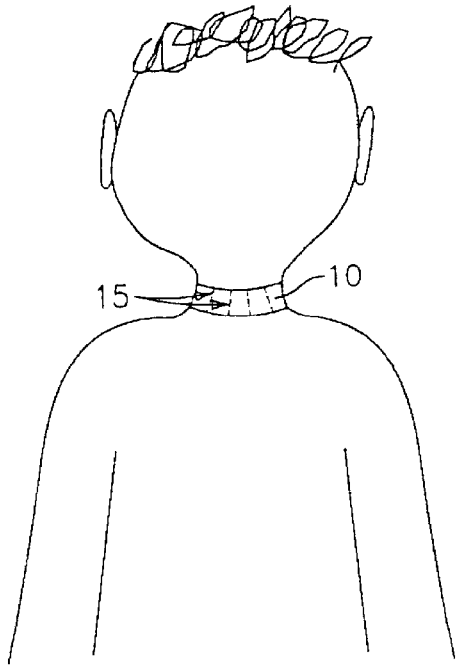
FIG. 2*b* shows a person wearing the necktie of FIG. 1 from behind.

Referring to FIGS. 2*a* and 2*b*, the necktie is shown tied around the neck of a wearer. For clarity, the necktie is exposed to view in the neck region although, of course, it would usually lie beneath a shirt collar. As seen in FIG. 2*a*, the tie is knotted at point 18. The wide end of the tie ("B" in FIG. 1) hangs down in front of the wearer, while the narrow end (A in FIG. 1) also lies in front of the wearer, but behind the wide end. (Narrow end A of the necktie is thus shown in phantom in FIG. 2*a*.)

The weakened regions 15 are positioned along the length of the tie such that one or more will lie along the portion of the tie surrounding the neck, away from the knot 18. Preferably, for the size of the tie, the weakened regions 15 would lie toward the back of the wearer's neck when tied, as shown in FIG. 2*b*.

If the hanging parts of the necktie shown in FIG. 2*a* catch onto something that is moving, the force will cause one or more of the weakened regions 15 to tear, thus allowing the tie to be pulled free of the wearer before the wearer's neck is injured. Positioning the weakened regions so that they will lie at the back of the wearer's neck ensures that the entire tie will be pulled free of the wearer. In addition, including a number of weakened regions 15 makes it likely that at least one is so positioned on the region around the wearer's neck, away from the knot 18. (While a number of weakened regions are preferable to ensure at least one lies in the desired position, the invention includes only one weakened region.) In addition, the perforations will normally be covered by the wearer's coller.

Figure 3A:
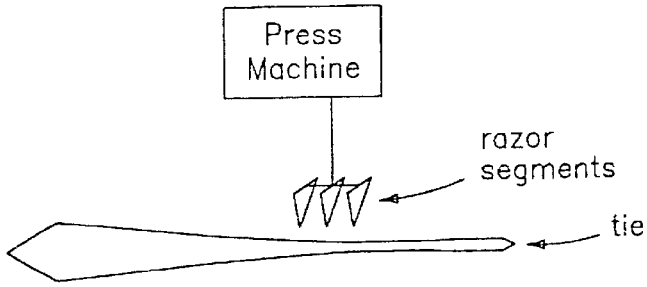
FIG. 3*a* is a schematic drawing of a device for constructing safety neckwear in accordance with the invention.
Figure 3B:
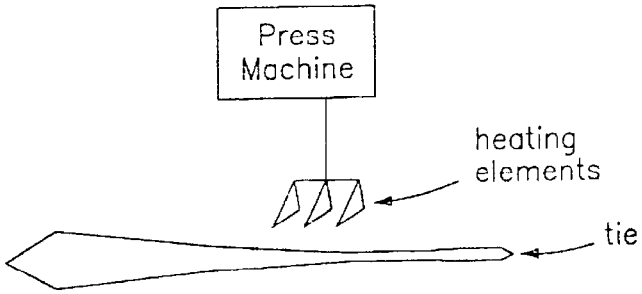
FIG. 3*b* is a schematic drawing of an alternative embodiment of a device for constructing safety neckwear in accordance with the invention.

The weakened regions 15 may be constructed in any manner that allows the tie to tear before the wearer's neck is injured. For weakened regions 15 comprised of perforations, the number or extent of the perforations in any weakened region may be adjusted so that it tears when a force known to be non-injurious is applied. In addition to perforations, the weakened regions may alternatively be created by intensely heating and weakening the silk fibers and the cloth interior. Alternatively, the tie may be cut in whole or in part and then adhered with an adherent having a relatively weak tensile strength. Fasteners, such as snaps, may be used instead of an adherent. Perforations may be made in the tie using, for example, a press machine that presses a row of razor sharp segments across and through the width of the tie, as shown in FIG. 3*a*. Intense heat may be applied to a narrow region across the width of the tie using a press machine that presses a soldering type metal edge against the tie as shown in FIG. 3*b*.

Figure 4A:
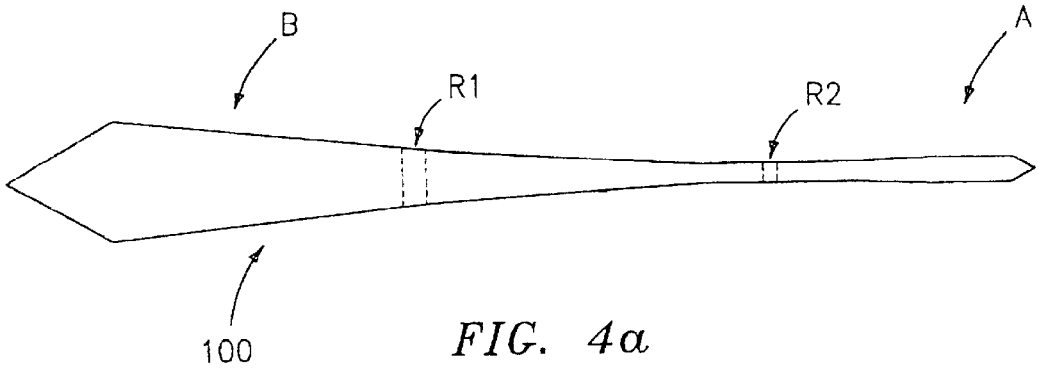
FIG. 4*a* is a necktie in accordance with an alternative embodiment of the invention.
Figure 4B:
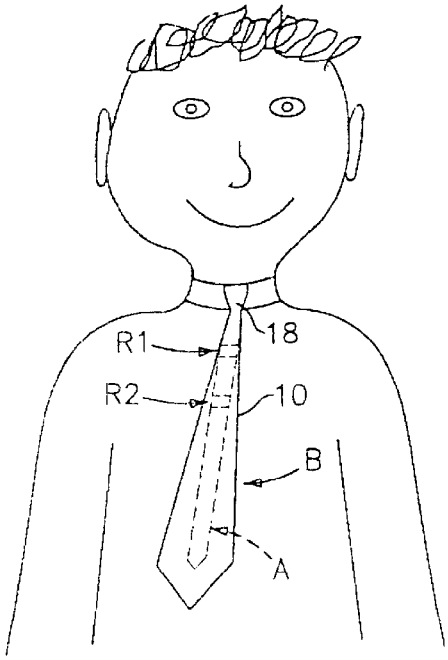
FIG. 4*b* shows a person wearing the necktie of FIG. 1 from the front.

The weakened regions need not be limited to one separable region on the tie and they may be positioned at alternative points on the tie. For example, FIG. 4*a* is an alternative embodiment of a tie 10 of the present invention showing one or more weakened regions (designated as separable region R2) on the narrow end A and one or more weakened regions (designated as separable region R1) at another location on the wide end B. FIG. 4*b* shows the tie 10 of FIG. 3*a* tied around a wearer's neck. As shown, narrow end A is represented in dashed lines since it lies between the wearer and wide end B. Separable region R2 on narrow end A and separable region R1 on wide end B both lie below the knot. 18. Thus, if narrow end A is pulled with sufficient force, it will tear away from the user via separable region R2. If wide end B is pulled with sufficient force, it will tear away from the user via separable region R1. And if both narrow end A and wide end B are pulled simultaneously with sufficient force, then they will both tear away from the wearer via separable regions R2 and R1 respectively.

As noted, the invention is applicable to any type of neckwear, including, for example, scarves. The position of the weakened region will vary based on the type of neckwear and its length. For any neckwear, it is preferable to have at least one weakened region positioned at the back of the wearer's neck.

What is claimed is:

1. An article of neckwear being one selected from the group of neckties and scarves, the article comprising at least one separable region formed in the fabric of the neckwear, the at least one separable region being at least one region of fabric having a reduced tensile strength, the separable region separating the neckwear into at least two portions when a force that exceeds a threshold is applied across the separable region, the separable region lying behind a wearer's neck when the neckwear is worn by the wearer.

2. The article of claim 1, wherein the article is selected from one of the group of neckties and scarves.

3. The article of claim 1, wherein the at least one separable region comprises perforations in the fabric.

4. The article of claim 1, wherein the at least one separable region comprises a heat treatment of the fabric.

5. The article of claim 1, wherein the threshold is less than a force needed to separate the neckwear into two segments at a region of the neckwear that is outside of the separable region.

6. A method of making an article of neckwear being one selected from the group of neckties and scarves, the method comprising the step of treating at least one region such that it has a reduced fabric strength than other regions of the neckwear, the region lying behind a wearer's neck when the neckwear is worn by the wearer.

7. The method as in claim 6, wherein the step of treating comprises cutting at least a portion of the at least one region.

8. The method as in claim 6, wherein the step of treating comprises heating at least a portion of the at least one region.

* * * * *